US008920220B2

(12) United States Patent
Kim et al.

(10) Patent No.: US 8,920,220 B2
(45) Date of Patent: Dec. 30, 2014

(54) POLISHING PAD FOR CHEMICAL MECHANICAL POLISHING APPARATUS

(75) Inventors: Ah-Ram Kim, Pyeongtaek-si (KR); Byeong-In Ahn, Daejeon (KR); Dong-Mok Shin, Daejeon (KR)

(73) Assignee: LG Chem, Ltd., Seoul (KR)

( * ) Notice: Subject to any disclaimer, the term of this patent is extended or adjusted under 35 U.S.C. 154(b) by 295 days.

(21) Appl. No.: 13/233,715

(22) Filed: Sep. 15, 2011

(65) Prior Publication Data

US 2012/0071068 A1 Mar. 22, 2012

(30) Foreign Application Priority Data

Sep. 15, 2010 (KR) ..... 10-2010-0090747

(51) Int. Cl.
*B24D 11/00* (2006.01)
*B24B 37/22* (2012.01)

(52) U.S. Cl.
CPC ..... *B24B 37/22* (2013.01)
USPC ..... 451/527

(58) Field of Classification Search
CPC ..... B24B 37/22; B24B 37/26
USPC ..... 451/526, 527, 529; D8/70
See application file for complete search history.

(56) References Cited

U.S. PATENT DOCUMENTS

| | | | | |
|---|---|---|---|---|
| 5,527,215 | A * | 6/1996 | Rubino et al. | 451/527 |
| 5,611,649 | A * | 3/1997 | Matthias | 407/118 |
| 5,984,769 | A * | 11/1999 | Bennett et al. | 451/527 |
| 6,089,963 | A | 7/2000 | Wiand et al. | |
| 6,261,168 | B1 * | 7/2001 | Jensen et al. | 451/527 |
| 6,585,579 | B2 * | 7/2003 | Jensen et al. | 451/527 |
| 6,685,548 | B2 * | 2/2004 | Chen et al. | 451/526 |
| 6,729,950 | B2 | 5/2004 | Park et al. | |
| 7,156,721 | B2 | 1/2007 | Palaparthi | |
| 8,287,793 | B2 * | 10/2012 | Deopura et al. | 264/299 |
| 2003/0034131 | A1 * | 2/2003 | Park et al. | 156/345.12 |
| 2003/0199234 | A1 * | 10/2003 | Chen et al. | 451/41 |
| 2006/0019587 | A1 | 1/2006 | Deopura et al. | |
| 2006/0046626 | A1 * | 3/2006 | Renteln | 451/527 |
| 2009/0104849 | A1 | 4/2009 | Wang | |

(Continued)

FOREIGN PATENT DOCUMENTS

| | | | |
|---|---|---|---|
| JP | 07-27754 | U | 5/1995 |
| JP | 2001-071256 | A | 3/2001 |

(Continued)

OTHER PUBLICATIONS

International Search Report issued in International Appln. No. PCT/KR2011/006748 mailed Apr. 27, 2012, 2 pages.

*Primary Examiner* — Joseph J Hail
*Assistant Examiner* — Joel Crandall
(74) *Attorney, Agent, or Firm* — Rothwell, Figg, Ernst & Manbeck, P.C.

(57) ABSTRACT

This disclosure relates to a polishing pad for chemical mechanical polishing, having a shape where 3 or more semi-oval or semicircular curves that connect 2 valleys neighboring on the plane are connected, and including 2 or more modified patterns that are formed to a determined thickness on the polishing pad, wherein a peak of one modified pattern and a valley of another modified pattern neighboring thereto are sequentially located on the same line. The polishing pad may uniformly disperse slurry over the whole area during a polishing process to provide improved polishing uniformity, and appropriately control residence time of the slurry to increase polishing rate.

7 Claims, 5 Drawing Sheets

(56) References Cited

U.S. PATENT DOCUMENTS

| | | | | |
|---|---|---|---|---|
| 2009/0181608 | A1 | 7/2009 | Li et al. | |
| 2009/0258575 | A1 * | 10/2009 | Hreha et al. | 451/37 |
| 2009/0311955 | A1 * | 12/2009 | Kerprich et al. | 451/548 |

FOREIGN PATENT DOCUMENTS

| | | | |
|---|---|---|---|
| JP | 2004501789 | A | 1/2004 |
| JP | 2005001083 | A | 1/2005 |
| JP | 2005106085 | A | 4/2005 |
| JP | 2005-183708 | A | 7/2005 |
| JP | 2005-294412 | A | 10/2005 |
| JP | 2008507417 | A | 3/2008 |
| KR | 1998-084298 | A | 12/1998 |
| KR | 10-0314866 | B1 | 11/2001 |
| KR | 10-2002-0022198 | A | 3/2002 |
| KR | 10-2003-0015567 | A | 2/2003 |
| KR | 10-2004-0036254 | A | 4/2004 |
| KR | 10-0597710 | B1 | 7/2006 |
| KR | 10-2008-0061940 | A | 7/2008 |

* cited by examiner

POLISHING PAD FOR CHEMICAL MECHANICAL POLISHING APPARATUS

TECHNICAL FIELD

The present invention relates to a polishing pad for chemical mechanical polishing, and more particularly to a polishing pad for CMP that may uniformly disperse slurry over a whole area during a polishing process to provide improved polishing uniformity, and appropriately control residence time of the slurry to increase polishing rate.

This application claims the benefit of the filing date of Korean Patent Application No. 10-2010-0090747, filed with Korean Intellectual Property Office on Sep. 15, 2010, the contents of which are incorporated herein.

BACKGROUND OF ART

Recently, for electrical isolation between devices of a semiconductor device such as a DRMA, a flash memory device, and the like, a shallow trench isolation (STI) process has been used. The STI process includes etching a semiconductor substrate on which a pad nitride film and the like is formed to form a trench, forming an oxide film for gapfill consisting of a silicon oxide film for filling the trench, and then conducting a planarization process for removing a step height generated due to excessive oxide film.

Previously, for the planarization process, various methods such as reflow, SOG, etchback, and the like have been used, however, these methods do not show satisfactory results according to the trend of high integration and high performance of a semiconductor device. For this reason, a chemical mechanical polishing (CMP) method has been most widely applied for the planarization process.

The CMP method is a method wherein a semiconductor substrate is put into contact with a polishing pad of a polishing apparatus and they are relatively moved while supplying a slurry composition including polishing particles and various chemical ingredients between the polishing pad and the semiconductor substrate to mechanically polish a film.

In general, in a chemical mechanical polishing process, a film to be polished is fixed on a carrier head and disposed so as to be opposite to a rotating polishing pad. The carrier head applies pressure to the rotating polishing pad while the film to be polished is fixed, thus enabling polishing. Further, the carrier head may rotate so as to provide additional movement between the substrate and a polishing surface.

In the chemical mechanical polishing process, a flat substrate surface may be provided by selecting an appropriate polishing pad and slurry to produce a high polishing speed. However, in the chemical mechanical polishing process, centrifugal force is generated by the rotation of the polishing pad, and thus the discharge speed of the polishing slurry increases toward the edge of the polishing pad. In addition, in the CMP process, pressure is applied to a film to be polished and the film contacts the polishing pad, however the polishing slurry does not easily move to the center of the film to be polished, and thus the center is insufficiently polished. That is, the existing CMP polishing pads may generate non-uniform polishing due to different polishing speeds at the center and the edge of a film to be polished, and this may cause inefficient polishing because of non-uniform distribution of the slurry during the polishing process.

Accordingly, there is a need for development of a method that may uniformly disperse slurry over the area and enable uniform polishing over the entire area of a film to be polished.

SUMMARY OF THE INVENTION

It is an object of the present invention to provide a polishing pad for CMP that may uniformly disperse slurry over the whole area during a polishing process to provide improved polishing uniformity, and appropriately control residence time of the slurry to increase the polishing rate, and a CMP apparatus including the polishing pad.

The present invention provides a polishing pad for CMP having a shape where 3 or more semi-oval or semicircular curves that connect 2 valleys neighboring on the plane are connected, and including 2 or more modified patterns that are formed to a determined thickness on the polishing pad, wherein a peak of one modified pattern and a valley of another modified pattern neighboring thereto are sequentially located on the same line.

The present invention also provides a CMP apparatus equipped with the polishing pad for CMP.

DESCRIPTION OF THE EMBODIMENT

Hereinafter, a polishing pad for CMP and a CMP apparatus according to specific embodiments of the invention will be described.

According to one embodiment of the invention, a polishing pad for CMP is provided, which has a shape where 3 or more semi-oval or semicircular curves that connect 2 valleys neighboring on a plane are connected, and includes 2 or more modified patterns that are formed to a determined thickness on the polishing pad, wherein a peak of one modified pattern and a valley of another modified pattern neighboring thereto are sequentially located on the same line.

By forming a modified pattern consisting of connected semi-oval or semicircular curves on the polishing pad, the total area of the pattern where a slurry passes during polishing and discharge processes may be largely increased, thus easily controlling residence time of the slurry compared to the existing polishing pad including concentric patterns, and the slurry may be uniformly dispersed over the whole area during a polishing process to realize improved polishing uniformity and a high polishing rate.

The term "pattern" refers to a dent formed to a determined depth and width on a polishing pad.

The semi-oval or semicircular curve refers to a curve that is connected in an oval or circular shape with two points located at the same distance from the center of the polishing pad as a starting point and an ending point. The semi-oval or semicircular shape does not necessarily need to be a complete semi-oval or semicircle, and it may be a part of a semi-oval or a semicircle.

Figure 1:
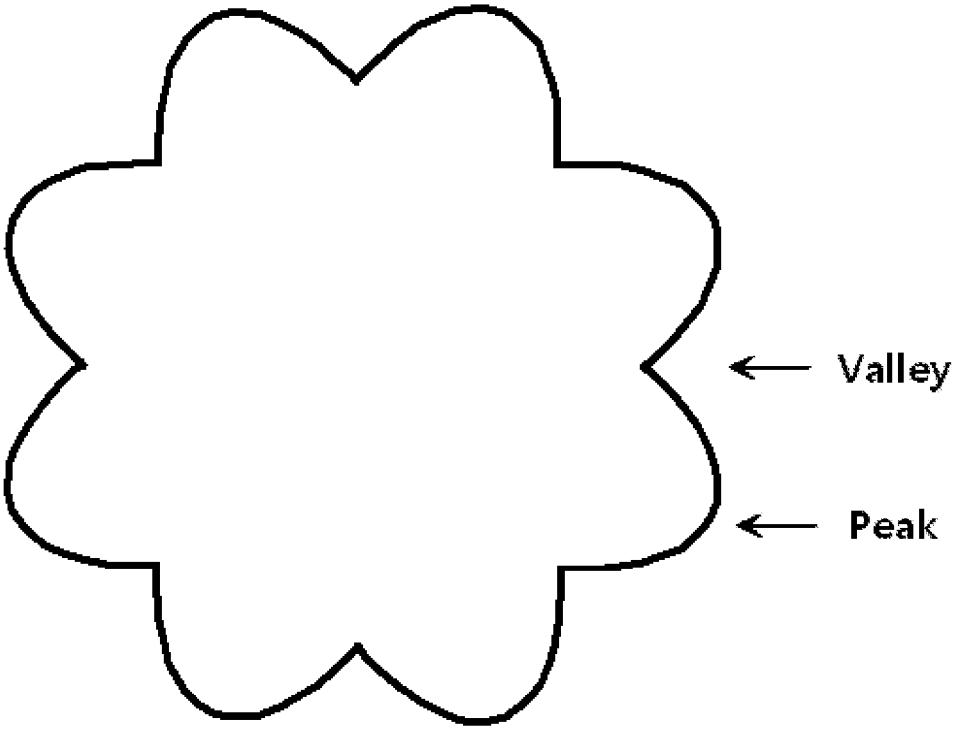
FIG. 1 schematically shows a modified pattern consisting of 8 connected semi-oval curves.
Figure 2:
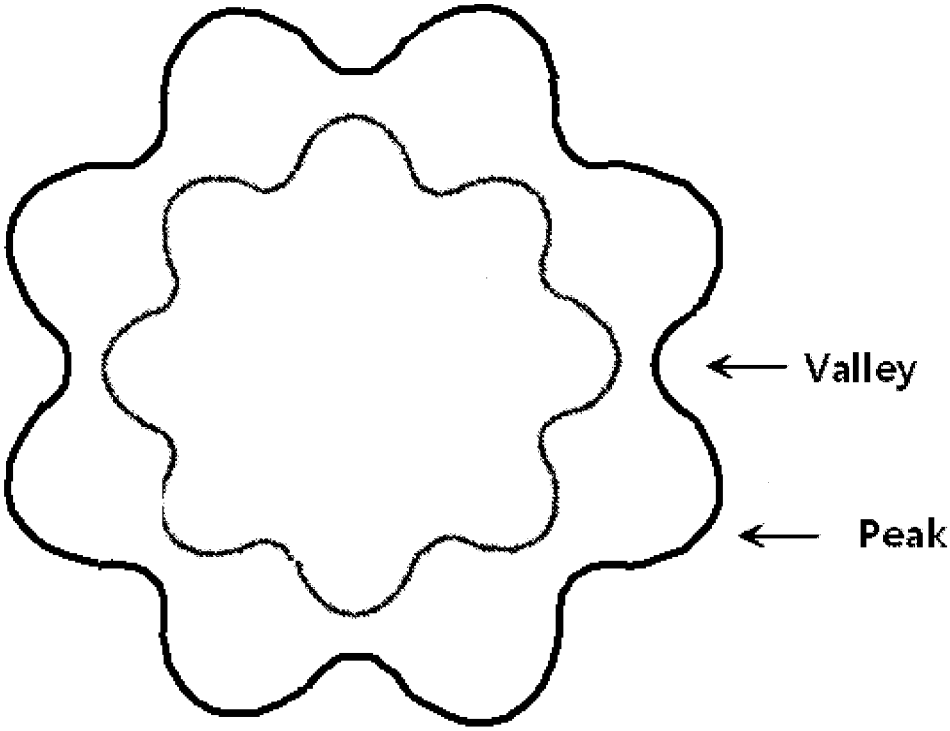
FIG. 2 shows an example wherein 2 modified patterns each consisting of 8 continuously connected semi-oval curves are arranged.

Three or more semi-ovals or semicircular curves may be connected to form a modified pattern, and the starting point or ending point of each curve may be connected with each other to form a pattern. FIG. 1 schematically shows a modified pattern formed by 8 semi-oval curves connected with each other. However, FIG. 1 shows one example of the modified pattern, but the modified pattern is not limited thereto, and various modifications may be made thereto. For example, a valley where semi-oval or semicircular curves are connected may be one point where discontinuous lines are connected, as shown in FIG. 1, or it may be one point where a continuous line passes, as shown in FIG. 2.

The shape of the curves in one modified pattern may be the same or different, but it is preferable that semi-oval or semicircular curves of the same shape may be continuously connected.

The term "valley" refers to a point located at the shortest distance from the center of the polishing pad in one modified pattern, through which semi-oval or semicircular curves may be connected. The term "peak" refers to a point located at the longest distance from the center of the polishing pad in one modified pattern.

Figure 3:
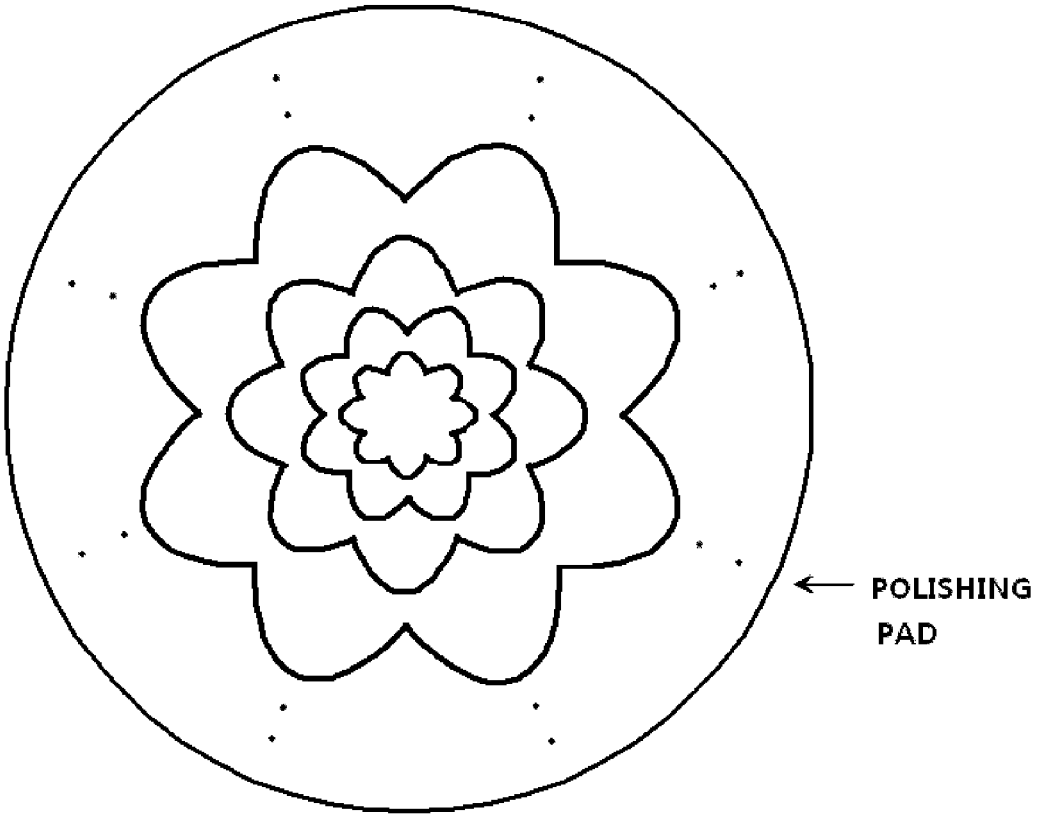
FIG. 3 schematically shows a polishing pad of Example 1 wherein a plurality of modified patterns are formed.

Meanwhile, on the polishing pad for CMP, the plurality of modified patterns may be formed such that a peak of one modified pattern and a valley of another modified pattern neighboring thereto may be continuously located on the same line from the center. In the plurality of modified patterns, a peak of one modified pattern and a valley of another modified pattern neighboring thereto may be arranged in a line in the outermost direction from the center of the polishing pad. Specifically, although each modified pattern has the same center, as shown in FIG. 3, if a straight line between the center of the polishing pad and the peak of a modified pattern located innermost is extended, it may be connected to a valley of another modified pattern surrounding the modified pattern, and then to a peak of the next modified pattern, which is repeated, thereby forming a plurality of modified patterns on the polishing pad.

Specifically, a polishing pad including the polarity of modified patterns, that is, 2 or more patterns where a peak of one modified pattern and a valley of another modified pattern neighboring thereto are repeatedly arranged in a line from the center, may more uniformly disperse slurry on the polishing pad than the existing patterns, because a peak and a valley are sequentially and alternately arranged in a line, and this may prevent residence of the slurry in a certain part for a long time, thus realizing improved polishing uniformity and polishing rate.

When the existing polishing pad including concentric patterns is used, polishing slurry may not easily move to the center of a film to be polished, and thus the center may be polished too little. To the contrary, because a peak and a valley of modified patterns are alternatively repeatedly arranged on the polishing pad for CMP, slurry may easily move between neighboring modified patterns, and the slurry may be uniformly distributed even in the center of the polishing pad, and thereby the polishing rate of the center of a film to be polished may be increased to largely improve polishing uniformity.

Further, according to the polishing pad for CMP of one embodiment of the invention, density of peaks and valleys increase toward the center of the polishing pad, and thus residence time of the slurry in the center of the polishing pad may be increased during a polishing process, thereby preventing non-uniform polishing generated by little polishing of the center of a film to be polished.

Specifically, as the peaks and valleys of modified patterns are alternately and repeatedly arranged in a line, slurry for CMP may move from the peak of one pattern to the valley of another pattern neighboring thereto in the outside direction during a polishing process, and the moved slurry moves along the groove (line between a valley and a peak in a semi-oval or semicircular curve) of the pattern, and then moves again from the peak to the valley of neighboring pattern, which is repeated. Thereby, in the polishing pad for CMP according to one embodiment of the invention, the slurry for CMP may have a longer discharge path, and may be uniformly discharged in all directions while securing appropriate residence time.

Figure 5:
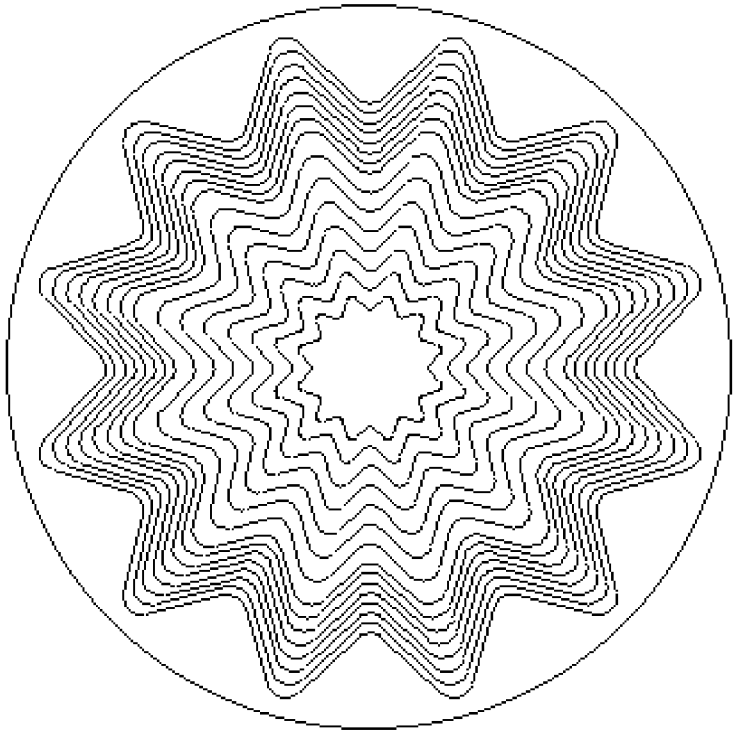
FIG. 5 schematically shows a polishing pad of Comparative Example 1 wherein patterns having the same center and arranged at regular intervals are formed.

To the contrary, as shown in FIG. 5, in a polishing pad where peaks (or valleys) of each pattern are arranged in a line from the center, the CMP slurry may be discharged along the straight line direction where peaks (or valleys) of neighboring patterns are arranged by the centrifugal force generated during the polishing process, and thus a relatively short discharge path may be exhibited, and a part having a relatively short slurry residence time may be generated.

The polishing pad for CMP may include first to $n^{th}$ modified patterns, and it may have a shape where a $k^{th}$ modified pattern surrounds a $k-1^{th}$ modified pattern on the plane. Herein, n may be an integer of 2 or more, preferably an integer of from 5 to 1000, and k may be an integer of $2 \leq k \leq n$. Thereby, if a line from the center of the polishing pad where a peak (or a valley) of the $k-1^{th}$ modified pattern passes is extended, it may pass by the valley of the $k^{th}$ modified pattern.

Meanwhile, the width and depth of the modified pattern, and the distance between the modified patterns, may be appropriately controlled according to the kind, material, or used field of a film to be polished. For example, the modified pattern may have a width of 10 um to 1 cm, and it may be formed to a depth of 10 um to 2 mm on a polishing pad. If the pattern is formed too deeply, it may disturb the flow of slurry during a polishing process, and macroparticles generated by coagulation of polished film material and the slurry may remain inside the pattern to cause scratches.

In the polishing pad, a distance between the peak of one modified pattern and the valley of another modified pattern neighboring thereto may be 1 mm to 10 mm. If the distance between the peak and the valley becomes too narrow, sufficient time for which slurry may reside on the polishing pad may not be secured, and if the distance becomes too far, improvement in polishing uniformity may be insignificant and polishing performance may be deteriorated.

The distance between the center of the polishing pad and each modified pattern may be appropriately controlled considering polishing performance or the number of modified patterns, and the like.

The shape of the cross-section of the depth of the modified pattern may include any shapes without specific limitation, as long as it is known to be applicable for a polishing pad for CMP, and for example, it may be a rectangle, a square, or a U-shape, but is not limited thereto.

Figure 4:
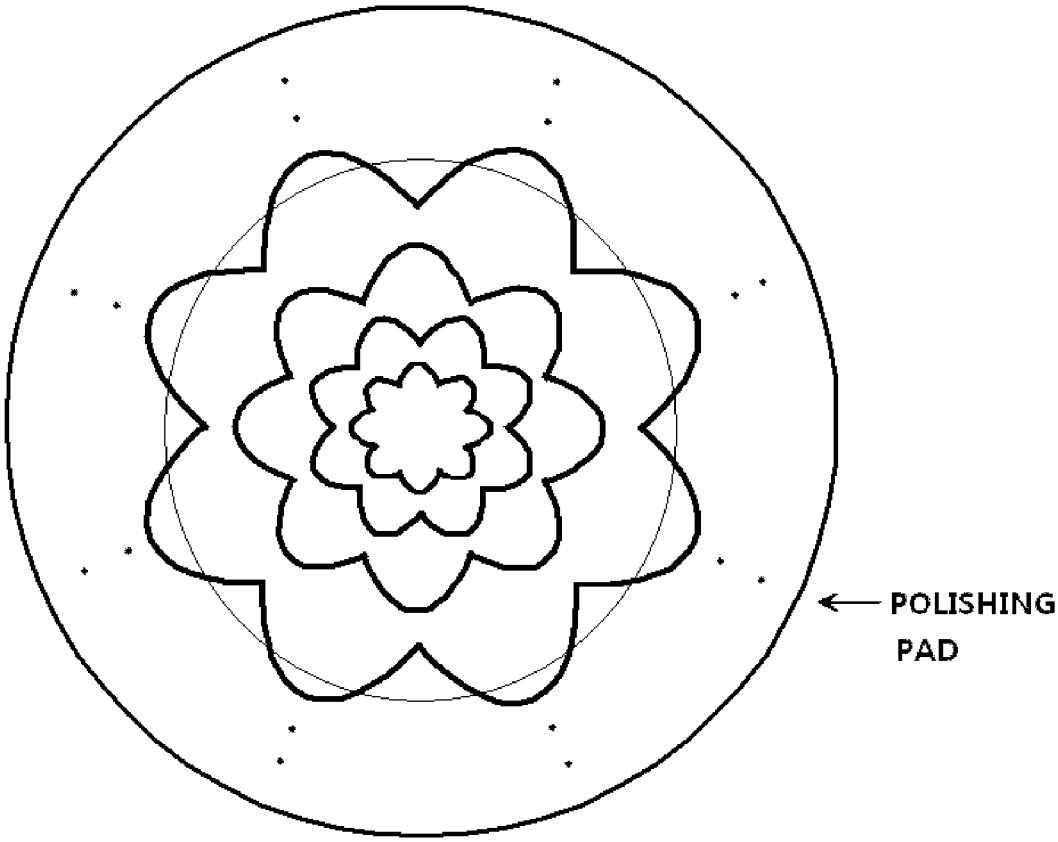
FIG. 4 schematically shows a polishing pad of Example 2 wherein a plurality of modified patterns and a concentric pattern are formed.

Meanwhile, the polishing pad may further include a concentric pattern formed to a predetermined depth. At least one concentric pattern may be formed on a certain part of a polishing pad according to polishing performance, polishing uniformity, and the properties of a film to be polished, and for example, it may be formed between neighboring modified patterns or while overlapping a certain part of the modified pattern. FIG. 4 schematically shows one example of a polishing pad wherein one modified pattern and one concentric pattern overlap.

Specifically, at least one concentric pattern may be formed outside of ½ of the radius of a polishing pad from the center of the polishing pad in order to control higher discharge speed of slurry toward the edge of the polishing pad due to centrifugal force during a polishing process.

The concentric pattern may be circular or oval, and preferably a circular shape, namely a pattern wherein a distance between the center of the polishing pad and all points on the concentric pattern is identical. Further, the concentric pattern may be formed as a continuously connected line, or as a dotted line consisting of certain points or a part of a pattern.

The width and depth of the concentric pattern and the distance between modified patterns may be appropriately controlled according to the kind, material, or use field of a film to be polished. For example, the concentric pattern may have a width of 10 um to 1 cm, and it may be formed to a depth to 10 um to 2 mm.

Meanwhile, according to another embodiment of the invention, a CMP apparatus is provided that includes the above described polishing pad for CMP, a supply part for supplying polishing slurry to the polishing pad, a polishing head part for introducing a wafer to be polished on the pad, and a pad conditioner for removing residue generated by the polishing of the wafer and maintaining the polishing pad at a constant state.

According to the present invention, a polishing pad for CMP, which may uniformly disperse slurry over the whole area during a polishing process to provide improved polishing uniformity, and may appropriately control the residence time of the slurry to increase polishing rate, may be provided.

EXAMPLES

Hereinafter, the present invention will be explained with reference to the following examples. However, these examples are only to illustrate the invention, and the scope of the invention is not limited thereto.

Examples and Comparative Example

Manufacture of a Polishing Pad

Example 1

On a polishing pad for CMP, a plurality of modified patterns were formed to a depth of 1 mm, as shown in FIG. 3. The distance between a peak of one modified pattern and a valley of another modified pattern neighboring thereto was set to 2 mm.

Example 2

As shown in FIG. 4, a polishing pad was manufactured by the same method as Example 1, except that a concentric pattern (depth 1 mm) was additionally formed at a ⅔ point of the radius of the polishing pad from the center of the polishing pad.

Comparative Example

As shown in FIG. 5, a polishing pad was manufactured wherein a plurality of patterns having the same center and arranged at regular intervals were formed to a depth of 1 mm.

Experimental Example

Polishing was conducted using the polishing pads of the examples and comparative example, and as a result, it was confirmed that the polishing pad of the examples may uniformly disperse slurry over the whole area to proved more improved polishing uniformity, compared to the polishing pad of the comparative example, and may appropriately control the residence time of the slurry to further increase the polishing rate.

*Polishing Conditions

An 8-inch $SiO_2$ wafer deposited to 6000 Å by HDP was polished for 1 minute under the following polishing conditions.

[polishing conditions]

Polishing apparatus: Gnp Technology Poli-500 8-inch machine

Platen speed: 87 rpm

Carrier speed: 93 rpm

Pressure: 1.5 psi

Slurry flow rate: 200 ml/min

The invention claimed is:

1. A polishing pad for chemical mechanical polishing, comprising 2 or more patterns that are formed to a determined thickness on the polishing pad, wherein each of the patterns has a shape where 3 or more semi-oval or semicircular curves connect valleys neighboring on a plane, and wherein peaks of each pattern are arranged on same lines extending from the center of the polishing pad as corresponding valleys of neighboring patterns.

2. The polishing pad for chemical mechanical polishing according to claim 1, wherein distances from the center of the polishing pad to the valleys of each pattern are identical, and distances from the center of the polishing pad to the peaks of each pattern are identical.

3. The polishing pad for chemical mechanical polishing according to claim 1, wherein a distance between the peak of one pattern and the valley of another pattern neighboring thereto is 1 mm to 10 mm.

4. The polishing pad for chemical mechanical polishing according to claim 1, wherein the pattern has a width of 10 μm to 1 cm.

5. The polishing pad for chemical mechanical polishing according to claim 1, wherein the pattern has a depth of 10 μm to 2 mm.

6. The polishing pad for chemical mechanical polishing according to claim 1, further comprising at least one concentric pattern formed to a predetermined depth, and wherein the concentric pattern is formed outside of ½ of the radius of a polishing pad from the center of the polishing pad.

7. A CMP apparatus comprising:

the polishing pad for CMP according to claim 1;

a supply part for supplying polishing slurry to the polishing pad;

a polishing head part for introducing a wafer to be polished on the pad; and a pad conditioner for removing residue generated by the polishing of the wafer, and maintaining the polishing pad at a constant state.

* * * * *